United States Patent [19]

Steinman

[11] 4,173,295

[45] Nov. 6, 1979

[54] BARREL DISPENSING SUPPORT

[75] Inventor: Dieter Steinmann, Glendale, N.Y.

[73] Assignee: European Design Corporation, Glendale, N.Y.

[21] Appl. No.: 853,358

[22] Filed: Nov. 21, 1977

[51] Int. Cl.[2] ..... B05D 17/16; B05D 25/36

[52] U.S. Cl. ..... 222/81; 137/318; 222/131; 222/185

[58] Field of Search ..... 137/318; 222/81, 82, 222/89, 131, 181, 183, 185, 464, 563

[56] References Cited

U.S. PATENT DOCUMENTS

| | | | |
|---|---|---|---|
| 166,889 | 8/1875 | Porter | 222/185 X |
| 599,027 | 2/1898 | Thompson | 222/185 X |
| 1,207,278 | 12/1916 | Cordley | 222/131 |
| 1,515,240 | 11/1924 | Cox | 137/318 X |
| 1,557,861 | 10/1925 | Moveida | 222/82 |
| 2,643,044 | 6/1953 | Sundhölm | 222/185 X |
| 2,698,703 | 1/1955 | Harvey | 222/185 X |
| 3,367,353 | 2/1968 | Hunter | 137/318 X |

*Primary Examiner*—David A. Scherbel
*Attorney, Agent, or Firm*—Seidal, Gonda, Goldhammer & Panitch

[57] ABSTRACT

A one way beer barrel dispensing support is provided to facilitate dispensing a beverage from the barrel by gravity flow. The support has a circular area on its upper surface for receiving the bottom end of a beverage barrel. A conduit is mounted in said circular area and has an inlet which enters the barrel when the barrel is placed on the support. The end of the conduit remote from the inlet has a valved spigot to control dispensing.

11 Claims, 3 Drawing Figures

BARREL DISPENSING SUPPORT

BACKGROUND

The tapping of a keg of beer or the like usually involves injecting carbon dioxide or some other gas into the barrel, involves the use of a pump, or some other device. Such devices are too complicated for the average citizen, when in use beer is sprayed during the initial tapping, and are otherwise objectionable in that they effect the taste of the beer. A much smoother taste is attained when the beer is dispensed by gravity flow. For small barrels, 1 to 3 gallons, there is no device available to facilitate dispensing the beer by gravity flow. The present invention is a solution to that problem.

SUMMARY OF THE INVENTION

The present invention is directed to a device for use with a beverage barrel from which it is desired to dispense the beverage by gravity flow. The device includes a support having a circular area on its upper surface for receiving the bottom end of a beverage barrel. A conduit is provided and has at least an end portion thereof mounted on the support in said area. An inlet communicates with said one end portion of said conduit and projects upwardly therefrom.

A valved spigot is connected to the other end portion of the conduit at a location beyond said area. A beverage barrel is tapped by placing the barrel on said support and causing said inlet to enter through a seal in the bottom wall of the barrel.

It is an object of the present invention to provide a novel one way beer barrel dispensing support which facilitates dispensing the beverage by gravity flow.

It is another object of the present invention to provide a one way beer barrel dispensing support which eliminates the need for carbon dioxide cartridges, hand pumps, and the like for tapping a beer barrel.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings in detail wherein like numerals indicate like elements, there is shown in FIG. 1 a device in accordance with the present invention designated generally as 10 and adapted for use with a beverage barrel from which it is desired to dispense the beverage by gravity flow.

Figure 1:
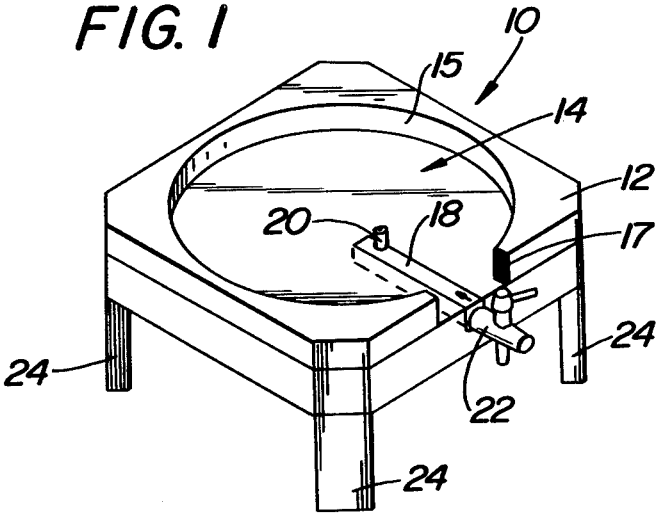
FIG. 1 is a perspective view of a device in accordance with the present invention.

The device 10 includes a support 12 having a circular area 14 on its upper surface for receiving the bottom end of a beverage barrel. The area 14 is defined at its periphery by an upstanding wall 15 notched as shown at 17. In the area 14, the support 12 is provided with a radially disposed channel 16. Channel 16 is preferably non-circular. As shown, channel 16 is rectangular in cross-section.

A dispensing conduit 18 is disposed within the channel 16. Conduit 18 is at lest as long as channel 16. The upper surface on conduit 18 is flush with the surrounding surface of area 14. Due to the rectangular configuration of channel 16 and conduit 18, conduit 18 cannot rotate in the channel 16. A variety of different devices may be utilized to prevent rotation of conduit 18 with respect to channel 16 such as a pin and slot.

Conduit 18 is preferably of a length so as to extend from an area beyond the periphery of support 12 to a location which is radially outwardly from the center of area 14. Adjacent one end portion of conduit 18, there is provided an upstanding hollow inlet 20. Adjacent the other end portion of conduit 18, and beyond the periphery of support 12, there is provided a valved spigot 22. The support 12 is provided with legs 24 or any other equivalent means which raises the discharge end of the spigot 22 above a support surface such as a table or the like whereby a glass or pitcher may be placed beneath the spigot 22.

The components of the present invention assume the position as shown in FIG. 1 immediately prior to tapping a barrel. A barrel 26 is provided in its bottom wall 28 with a conventional breakable seal 30. Seal 30 is spaced from the longitudinal axis of the barrel 26 so as to be directly above the inlet 20. As the barrel 26 is lowered onto the support 12, inlet 30 ruptures seal 30 and extends through the bottom wall 28 into the barrel 26.

The top wall of the barrel 26 is provided with a seal similar to seal 30 but on the longitudinal axis of barrel 26. A manually adjustable vent valve 32 is inserted into the barrel 26 through the seal on the top wall thereof.

A heat shield 34 in the form of a barrel shell surrounds the barrel 26 and has its lower end disposed within the area 14 in close proximity to the wall 15. Shell 34 is preferably made from a foam plastic material which acts as a heat insulator. The shell 34 lacks a bottom wall and has a hole centrally located in its top wall through which the vent valve 32 may extend.

The barrel 26 preferably has a capacity of 1 to 3 gallons. By locating seal 30 radially outwardly from the longitudinal axis of the barrel 26 and by having the seal for vent valve 32 along the axis of barrel 26, the possibility of a user positioning the barrel 26 upside down is avoided. Nevertheless, it is within the scope of the present invention to have the seals on the opposite walls of the barrel 26 both located along the longitudinal axis thereof.

The present invention is utilized as follows. The device 10 is placed on a table or the like. A refrigerated barrel of beer 26 is positioned over the device 10 with the seal 30 aligned with the inlet 20. As the barrel 26 is lowered onto the device 10, inlet 20 pierces the seal 30 and extends into the barrel 26. Barrel 26 may be provided with a guide mark to be aligned with the arrow on conduit 18.

One or two glasses of beer may then be dispensed by manipulating the valved spigot 22. Thereafter, it is necessary to pierce the seal on the top wall of barrel 26 by means of the vent valve 32. Vent valve 32 is of conventional construction and includes a threaded nut which controls the venting of air which enters the barrel 26 to replace the dispensed beer. The shell 34 is placed over the barrel 26 to maintain the barrel refrigerated.

Figure 2:
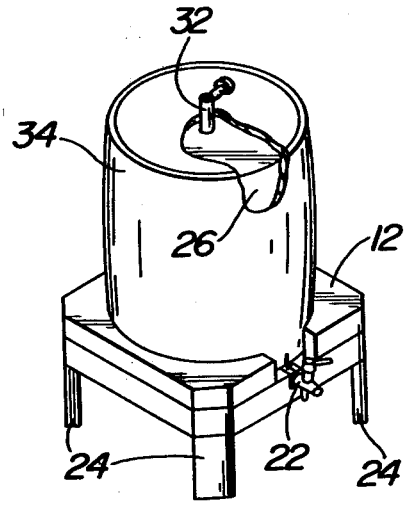
FIG. 2 is a perspective view of the device of the present invention with a beer barrel supported thereby and with a heat shield surrounding the barrel.
Figure 3:
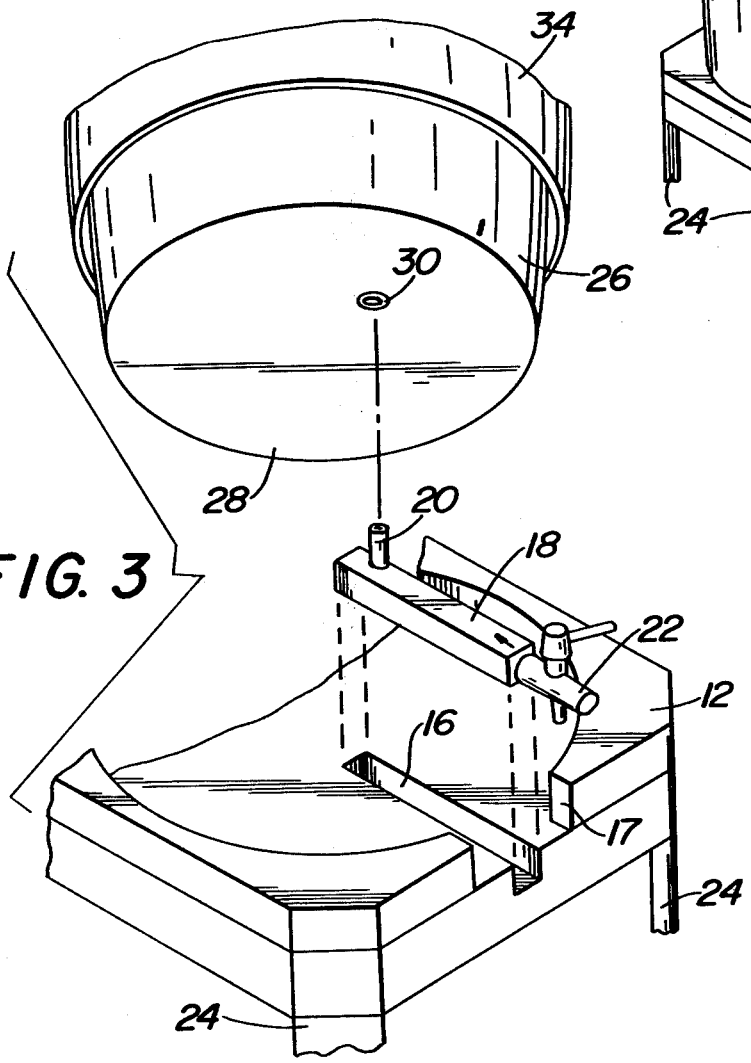
FIG. 3 is an exploded partial perspective view of the present invention in FIG. 1 but on an enlarged scale.

Beer is dispensed from the barrel 26 by gravity flow thereby preserving the smoothness of the beer and without the usual tapping apparatus involving pumps or carbon dioxide cartridges. During dispensing, the barrel is upright as shown in FIG. 2. After all of the beer has been dispensed from barrel 26, shell 34 is removed upwardly and placed to one side. Thereafter, the barrel 26 is lifted upwardly and removed. If desired, a new barrel may be tapped in the manner as described above. The conduit 18 with its inlet 20 and spigot 22 is readily removable from the channel 16 for purposes of cleaning. Due to notch 17, conduit 18 is readily removed in an upward direction.

The device 10 may be made of wood, plastic or other suitable materials or a combination thereof to facilitate ease of cleaning and the preventing of corrosion. In the preferred embodiment, the support 12 is cast from any one of a variety of polymeric plastics and then is coated or otherwise formed so as to simulate the wood grain in a piece of wood. In the preferred embodiment, the legs 24 are made of wood and adhesively bonded to the support 12. The conduit 18 with its inlet 20 and spigot 22 are preferably made from a non-corrosive metal such as aluminum, brass, etc.

The present invention may be embodied in other specific forms without departing from the spirit or essential attributes thereof and, accordingly, reference should be made to the appended claims, rather than to the foregoing specification as indicating the scope of the invention.

I claim:

1. A device for use with a beverage barrel from which it is desired to dispense the beverage by gravity flow comprising a support having a circular area on its upper surface for receiving the bottom end of a beverage barrel wherein said support is provided with a channel on an upper surface thereof extending to a periphery of said support, a conduit having one end portion thereof mounted on said support and radially disposed with respect to said circular area, said conduit being located in said channel, an inlet communicating with said one end portion of said conduit and projecting upwardly therefrom, a valved spigot connected to the other end portion of said conduit and being at a location beyond the peripherial portion of said support for dispensing a begerage from a barrel, whereby a beverage barrel may be tapped by placing the barrel on said support and causing said inlet to simultaneous enter through a seal of the bottom wall of the barrel.

2. A device in accordance with claim 1 including a hollow bottomless heat shield having a diameter at its bottomless end which is slightly smaller than the diameter of said circular area and receivable in said circular area.

3. A device in accordance with claim 1 including means associated with said conduit and channel to prevent rotation of said conduit within said channel so that a discharge end of the spigot remains in a position for dispensing downwardly.

4. A device in accordance with claim 3 wherein said means includes said conduit being rectangular in cross section, said channel being rectangular in cross section.

5. A device in accordance with claim 1 wherein said conduit inlet is spaced from the periphery of said circular area by a distance less than a radius of said circular area.

6. A device in accordance with claim 1 including a plurality of legs connected to said support.

7. A device in accordance with claim 1 wherein said circular area is recessed in said upper surface.

8. A device for use with a beer barrel from which it is desired to dispense beer by gravity flow comprising a support mounted on legs, said support having a circular area on its upper surface for receiving the bottom end of a beverage barrel, a conduit recessed in a channel which is radially disposed with respect to said circular area, means for preventing said conduit from rotating with respect to said channel, said conduit having an inlet communicating with one end portion of said conduit, said inlet projecting upwardly from said conduit, a valved spigot connected to the other end portion of said conduit at a location beyond said support, whereby a beer barrel may be tapped by placing the beer barrel on said support and simultaneously causing said inlet to enter through a seal in a bottom wall of the barrel.

9. A device in accordance with claim 8 wherein said circular area is recessed in the upper surface of said support, and said conduit having a length at least as long as said channel.

10. A device in accordance with claim 8 wherein said means to prevent rotation between said conduit and said channel includes the channel being rectangular in cross-section, and said channel being rectangular in cross-section.

11. A device for use which a beer barrel from which it is desired to diepense beer by gravity flow comprising a support mounted on a leg means, said support having a defined area on its upper surface for receiving the bottom end of a beverage barrel, wherein said support is provided with a channel on an upper surface thereof extending to a periphery of said support, a conduit mounted on said support, said conduit being located on said channel, means for preventing said conduit from rotating with respect to said support, said conduit having an inlet communicating with one end portion of said conduit, said inlet projecting upwardly from said conduit at a location within said area, a valved spigot connected to the other end portion of said conduit at a location beyond said support, whereby a beer barrel maybe tapped by placing the beer barrel on said support and simultaneously causing said inlet to enter into a seal in a bottom wall of the barrel.

* * * * *